US005836631A

United States Patent [19]

Coe

[11] Patent Number: 5,836,631

[45] Date of Patent: Nov. 17, 1998

[54] LOAD LEVELING SLING RIGGING APPARATUS

[75] Inventor: Kenneth A. Coe, Lebanon, Ind.

[73] Assignee: American Steel Investment Corporation, Fort Wayne, Ind.

[21] Appl. No.: 853,510

[22] Filed: May 9, 1997

[51] Int. Cl.[6] ..... B66C 1/12

[52] U.S. Cl. ..... 294/74; 294/82.12

[58] Field of Search ..... 294/74, 82.11, 294/82.12, 82.14; 24/68 R, 70 ST, 68 CD, 129 R, 198, 200

[56] References Cited

U.S. PATENT DOCUMENTS

| | | | |
|---|---|---|---|
| 3,602,544 | 8/1971 | Marsh | 294/74 |
| 3,709,548 | 1/1973 | Hogshead | 294/74 |
| 4,525,007 | 6/1985 | Chapalain | 294/74 |
| 4,762,355 | 8/1988 | Hogg | 294/74 |
| 4,850,629 | 7/1989 | St. Germain | 294/74 |
| 5,058,243 | 10/1991 | Rasmussen | 294/74 |

FOREIGN PATENT DOCUMENTS

| | | | |
|---|---|---|---|
| 1381-054 | 3/1988 | U.S.S.R. | 294/82.12 |

OTHER PUBLICATIONS

Product brochure entitled "Rigging Attachments–Catalog RA–1" by The Caldwell Company, Inc. of Rockford, IL, 1992, and especially pp. 4 and 5.

Product brochure entitled "Slingmax Rigging Products #9511," by Slingmax Rigging Products of Aston, PA, 1995, and especially p. 11.

*Primary Examiner*—Dean Kramer

*Attorney, Agent, or Firm*—Baker & Daniels

[57] ABSTRACT

An apparatus and method for rigging a sling between a load to be lifted and a lifting machine such as a crane. The sling rigging apparatus includes first and second plates which have a plurality of aligned apertures. A shaft is fixed between the plates and is attachable to a crane hook to allow the rigging apparatus to be raised. A plurality of sling engageable pins are insertable in a longitudinal direction through the aligned apertures to positions spanning a space between the plates. When inserted through the apertures, the pins are spaced from each other in a direction transverse to the longitudinal direction and arranged to define a multi-curved pathway. A sling positioned along this pathway contacts parts of the exterior peripheries of the plurality of pins, and when a load is applied on the sling, this contact with the pins causes the sling to be frictionally locked within the rigging apparatus.

16 Claims, 4 Drawing Sheets

LOAD LEVELING SLING RIGGING APPARATUS

BACKGROUND OF THE INVENTION

The present invention pertains to slings, and, in particular, to a rigging apparatus utilized to operatively interconnect a sling that suspends a load with a lifting machine capable of raising the load.

A lifting sling is frequently utilized to connect a heavy object requiring lifting to, for example, the hook of a crane capable of raising the object and maneuvering it into a desired location. Different styles of slings, including both eye-and-eye slings and endless slings, are presently used as lifting slings. Slings fashioned from wire rope have been workhorses in the industry for years. More recently developed round slings, which are considered in the industry as a type of sling known as a synthetic sling, have an internal core formed of multiple windings of a high tensile strength fibrous strand encased within a fabric cover and are finding frequent application in lifting tasks.

One difficulty with using slings to lift heavy loads is rigging the sling between the load and the crane or lifting machine such that the load is properly lifted. Loads should be lifted with a level attitude, and that attitude should be sustained throughout the entire lifting process. To achieve a level lift, the sling needs to be rigged so that the crane is located over the center of gravity of the load, regardless of the location of the available lifting points on the load. With conventional sling rigging methods, so rigging the sling may be problematic, especially for eccentric loads having offset centers of gravity where it may be difficult to estimate where the center of gravity is in fact located.

For example, when an elongated, non-eccentric load such as an iron beam is to be raised during the construction of a building, frequently the construction workers or ironworkers charged with attaching a fixed length sling to the beam utilize separate fittings, such as shackles or flange clamps or chokers, attachable to the beam itself and to which the sling may be connected. Because these beams may be relatively long, the ironworkers, rather than physically measuring the beam, may first eyeball the beam to estimate its midpoint and then attach the sling fittings such that the beam midpoint is roughly centered therebetween. Unless these fittings are positioned equal distances from the center of gravity of the beam, when a crane is operated to raise the sling attached between the crane hook and the fittings, the load may be improperly angled relative to the ground. The crane then must lower or set down the beam and the potentially time consuming task of loosening the fittings and then safely resecuring them to provide a better centering of the crane hook over the beam's center of gravity must be performed. After this task is completed, the load is raised again, and if an improper fitting relocation has been performed the whole process must be repeated. Because ironworkers installing the beam must be positioned both at the beam loading site as well as the beam unloading site on the building, and because a crane operator is also occupied with the beam lifting process, this process of repeatedly raising and lowering the beam and adjusting the fittings wastes the time of numerous people and is therefore very expensive to the construction project.

To aid the process of centering a crane hook over the center of gravity of a load, several products have been developed that permit the point at which the crane hook effectively engages the sling to be adjusted without adjusting the fittings attached to the load. One product is designed for use with wire rope slings, and the product can be moved along the sling length when not under load. A frictional locking of the sling occurs when a spring biased roller is pulled down by the weight of the load being lifted and the wire rope is forced into a V-groove to frictionally lock the wire rope from further motion. While perhaps functional with wire ropes, this product is inappropriate for use with synthetic slings such as round slings and web slings. Furthermore, this product includes moving parts which may complicate manufacture.

Another rigging tool known as an adjustable bridal sling includes a fitting attached to a sling, and the sling legs are formed by a double sling on one side of the fitting and a single sling on the other fitting side. The lengths of the double and single slings are adjustable by moving the fitting along the sling length to simultaneously shorten and lengthen different legs of the sling. A shortcoming of this design is that it is cumbersome to utilize and an overall longer sling is necessary to provide the double sling leg. Furthermore, in certain circumstances, adjusting the sling may be complicated by the need to determine which part of the double sling leg to pull on to effect lengthening.

Thus, it would be desirable to provide a sling rigging apparatus which overcomes these and other deficiencies of the prior art.

SUMMARY OF THE INVENTION

The present invention provides a sling rigging apparatus that allows a sling to be rigged to lift heavy loads, including eccentric loads, such that the loads are even or have a level attitude while being lifted. The apparatus employs pins removably assembled to apertured plates, and the pins when assembled are configured to define a serpentine path along which a synthetic sling connected to a load to be lifted may be arranged. Due to the contact between the sling and the pins, the serpentine path causes a frictional lock of the sling relative to the apparatus to occur during lifting of the load, and this frictional lock ensures that the attitude of the lifted load remains constant once lifted off the ground. The frictional lock is automatically released when the load is set down so as to permit any changes in the sling position relative to the apparatus to be intuitively and easily performed.

In one form thereof, the present invention provides a sling rigging apparatus comprising a first body member, a second body member operatively connected with the first body member, a suspension member on which an upward force may be applied to lift the first and second body members, wherein the suspension member is attached to at least one of the first and second body members, and a plurality of pins. The pins extend in a longitudinal direction to span a space between portions of the first and second body members. The pins are spaced from each other in a direction transverse to the longitudinal direction and arranged to define a multi-curved pathway along which a sling is positionable for frictional engagement with at least parts of the exterior peripheries of the pins.

In another form thereof, the present invention provides a sling rigging apparatus comprising a first body member comprising a first plurality of apertures, and a second body member operatively connected with the first body member and comprising a second plurality of apertures in alignment with the first plurality of apertures. The apparatus also includes a suspension member on which an upward force may be applied to lift the first and second body members, wherein the suspension member is attached to at least one of the first and second body members, and a plurality of sling engageable pins. Each of the plurality of pins is movable in a longitudinal direction through aligned apertures of the first and second plurality of apertures to a first position spanning a space between portions of the first and second body members, whereby a sling portion may be engaged. Each of the plurality of pins is also movable through the aligned apertures of the first and second plurality of apertures to a second position not spanning the space between portions of the first and second body members, whereby the rigging of the sling portion is facilitated.

In still another form thereof, the present invention provides a method of lifting a load with a lifting machine comprising the step of providing a sling rigging apparatus. The apparatus includes a body including a first body portion, a second body portion, and a third body portion, and a plurality of pins extending in a longitudinal direction to span a space between the first body portion and the second body portion. The pins are spaced from each other in a direction transverse to the longitudinal direction and arranged to define a multi-curved pathway. The method also comprises the steps of positioning a sling along the multi-curved pathway defined by the plurality of pins such that the sling frictionally engages at least parts of exterior peripheries of the plurality of pins, connecting the sling to the load, and connecting the third body portion to the lifting machine to allow raising of the sling rigging apparatus, the sling and the load.

One advantage of the present invention is that a sling rigging apparatus is provided that enables a load to be lifted with a sling in a level fashion despite less than optimal lifting points on the load being available or used.

Another advantage of the present invention is that the sling rigging apparatus is adapted for numerous rigging configurations to enable the apparatus to be utilized in a variety of applications.

Another advantage of the present invention is that the apparatus is easy to use so as to be installed and adjusted by even relatively inexperienced users.

Another advantage of the present invention is that the apparatus may be inexpensively manufactured and is relatively lightweight for convenience of use.

Still another advantage of the present invention is that the apparatus can operatively connect slings in a low profile manner, thereby allowing its use when head room is at a premium.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Figure 1:
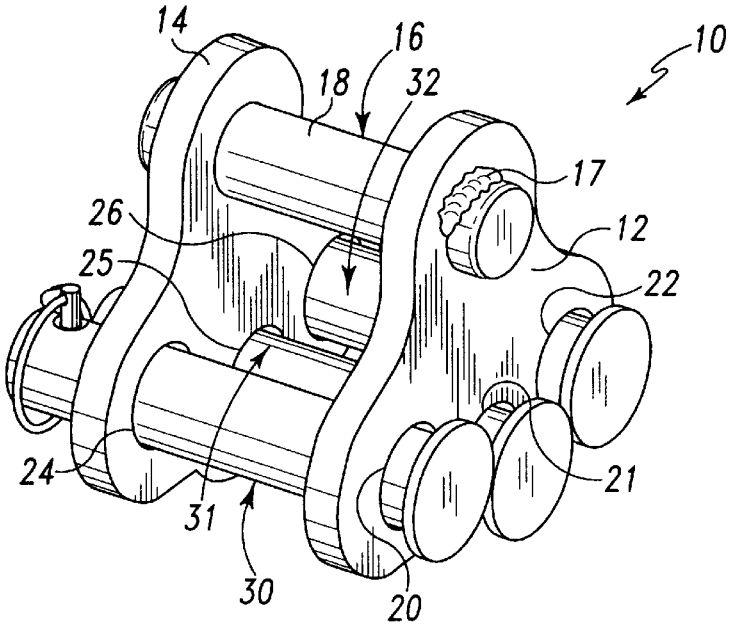
FIG. 1 is a perspective view of an exemplary embodiment of a fully assembled sling rigging apparatus in accordance with the principles of the present invention.

Corresponding reference characters indicate corresponding parts throughout the several views. Although the drawings represent an embodiment of the invention, the drawings are not necessarily to scale and certain features may-be exaggerated or omitted in order to better illustrate and explain the present invention.

DESCRIPTION OF THE PREFERRED EMBODIMENTS

Figure 2:
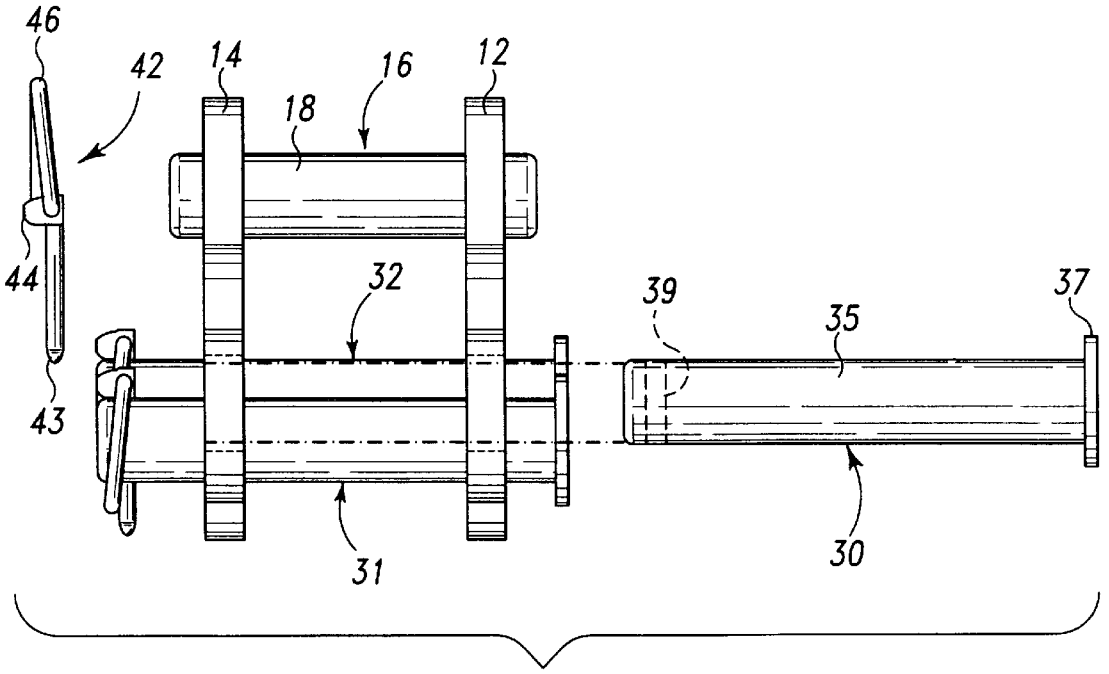
FIG. 2 is a side view of the sling rigging apparatus of FIG. 1 with one of the sling engageable pins shown detached from the remainder of the apparatus.

In FIG. 1, there is shown a perspective view of a sling rigging fitting or apparatus, generally designated 10, arranged in a fully assembled configuration and separate from the slings and other assorted attachments with which it may be employed to raise loads of various shapes and sizes. In FIG. 2, fitting 10 is shown in a side view and with one of its removable pins, namely pin 30, unlocked and pulled clear of the rest of the fitting.

With primary reference to FIGS. 1 and 2, fitting 10 includes a main body comprising an interconnected front plate 12, rear plate 14 and shaft 16. Front plate 12 is generally a four-lobed shaped plate and is spaced from and parallel to a mirrorimage rear plate 14. Plates 12 and 14 are constructed of a strong and rigid material, such as steel, that is capable of withstanding the large loadings placed on fitting 10 during use. Different materials of construction, as well as different plate thicknesses for such materials, may be selected based on the expected loadings on the fitting. A solid, cylindrical shaft 16 made of a high strength material such as steel spans the space between plates 12 and 14 and is fixedly attached to the top or upper portion of each of the plates, such as by welding indicated at 17. Shaft 16 typically serves as the means by which fitting 10 may be attached to a lifting machine, such as a crane. The exterior periphery 18 of shaft 16 is non-abrasive so as not to damage slings which may be wrapped or looped thereunder as described further below. The lower portion of front plate 12 includes three circular apertures 20, 21 and 22 through which sling engageable pins, generally designated 30, 31 and 32, are removably insertable. Three circular apertures 24, 25 and 26 through the lower portion of rear plate 14 are in alignment with apertures 20, 21 and 22, respectively, to allow for pin insertion. The shown aperture arrangement is merely illustrative and not limiting as different vertical and horizontal spacings of the apertures along their respective plates may be employed to modify the sling pathway.

Although shown as having multi-lobed outlines and uniform thicknesses, the body portions formed by plates 12 and 14 that provide the pin receiving apertures may be differently shaped within the scope of the invention. For example, plates 12 and 14 each may be replaced with multiple, interconnected apertured bars. The body portion by which fitting 10 may be suspended from lifting attachments may also be configured differently than the illustrated shaft 16 that also serves to connect the body plates. For example, an upwardly projecting hook or eye made of solid steel may be secured to shaft 16. Alternatively, the plate body portions could be attached together and shaft 16 or another attachment member such as a steel eye could be provided on an extension from one of the body plates.

Pins 30, 31 and 32 are separate component parts of fitting 10 that may be assembled to plates 12 and 14 when fitting 10 is to be utilized. In FIG. 2, pins 31 and 32 are shown assembled and locked to the fitting body, and pin 30 is shown completely clear of the fitting body. To facilitate rigging of the sling onto apparatus 10, pin 30 need not be completely removable as shown, but in an alternate embodiment may be shifted from the position shown in FIG. 1 to a position that protrudes into but does not span the space between plates 12 and 14. Pin 30 includes a uniformly cylindrical and smooth shaft 35 which at one end includes an enlarged head portion 37. Shaft 35 has a diameter sized to freely slide through apertures 20 and 24 of plates 12 and 14, respectively. For example, when apertures 20 and 24 each have a diameter of approximately one and one-sixteenth inch, pin shaft 35 has a diameter of about one inch. Head portion 37 is sized larger than aperture 20 so as to limit the longitudinal insertion of pin 30 through aperture 20. Near the insertion end of shaft 35, a cross bore 39 diametrically extends through shaft 35. Each of pins 31 and 32 is constructed similar to pin 30 and therefore not further explained herein.

To secure pin 30 in the assembled position shown in FIG. 1 after pin 30 is moved from the fully disassembled position shown in FIG. 2 through apertures 20 and 24, a locking clip or pin generally indicated at 42 may be used. Locking pin 42 includes an elongated finger portion 43 from which ear 44 laterally projects. A first end of split ring 46 fits into a recess provided in finger portion 43, and the opposite end of split ring 46 fits into a recess provided in ear 44. When locking pin 42 is arranged as shown in FIG. 2, finger portion 43 may be inserted into pin shaft bore 39. As split ring 46 is subsequently manually rotated about ear 44 in the counterclockwise direction from the perspective of a FIG. 2 viewer, due to the offsetting of its opposite ends, split ring 46 snaps downward around the shaft end and into contact with finger portion 43. Axial withdrawal of pin 30 from aperture 24 in back plate 14 is thereby prevented as locking pin 42 abuts back plate 14. Similar locking pins are provided for each of pins 31 and 32.

Differently shaped and constructed sling engageable pins alternatively may be employed. For example, cross-sectionally square, hollow pins may be used in conjunction with square apertures through the facing body plates. Square pins, which would preferably be rotationally oriented with a corner facing upward so that the pins appear more diamond shape from the perspective of a viewer facing the front of the sling rigging apparatus, may provide an increased load bearing area for the sling. Different methods of securing the sling engageable pins in an operational arrangement also may be substituted within the scope of the invention. For example, a cotter pin may be employed with cross bore 39, or nuts placed on threaded ends of sling engageable pins may be used. Alternatively, if the plates apertures were tapped bores, pins 30–32 could be provided with threaded exteriors along appropriate portions of their longitudinal lengths to permit their being screwed into either plate 12 or plate 14. Still further, additional numbers of sling engageable pins may be provided to increase the length of the serpentine path through which the sling may be threaded and increase the pin surface area frictionally engaged by the sling to further frustrate undesired sling movement during lifting.

Figure 3:
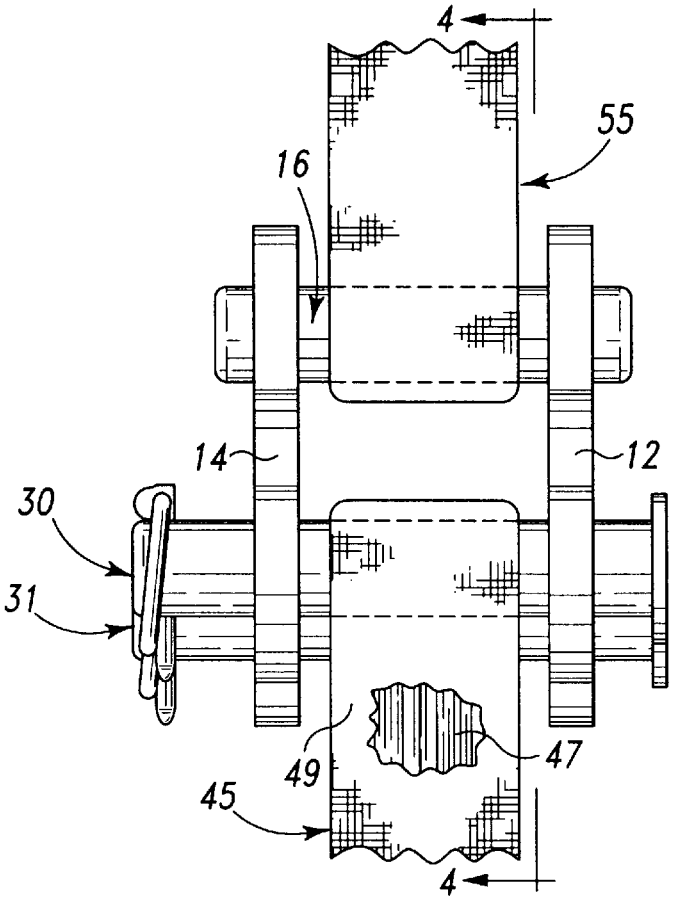
FIG. 3 is a side view of the sling rigging apparatus of FIG. 1 being employed to operatively interconnect a partially shown crane connecting sling with a partially shown load suspending sling.
Figure 4:
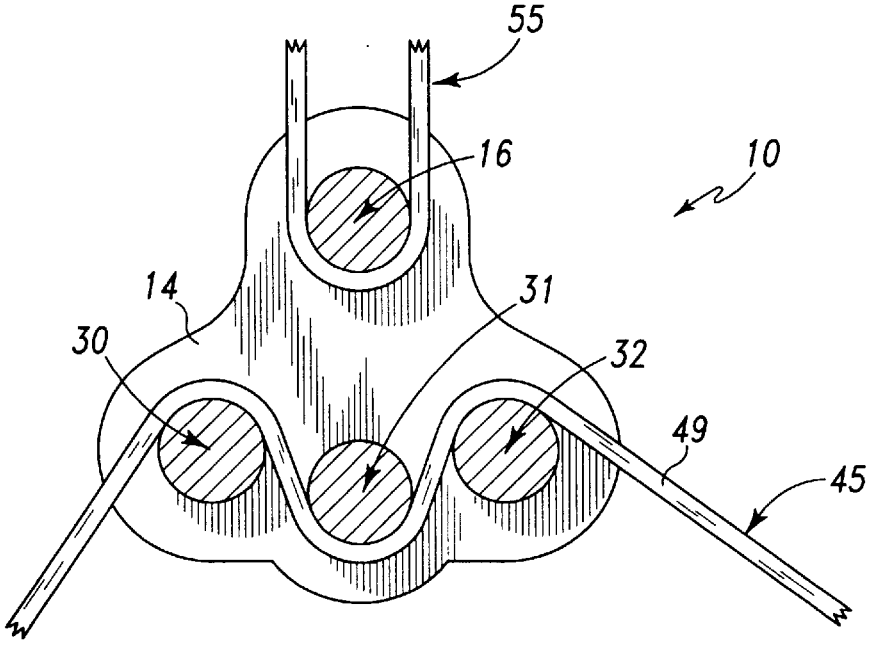
FIG. 4 is a cross-sectional front view, taken along line 4—4 of FIG. 3, further illustrating the manner in which the load suspending sling may be wrapped on the sling rigging apparatus.
Figure 5:
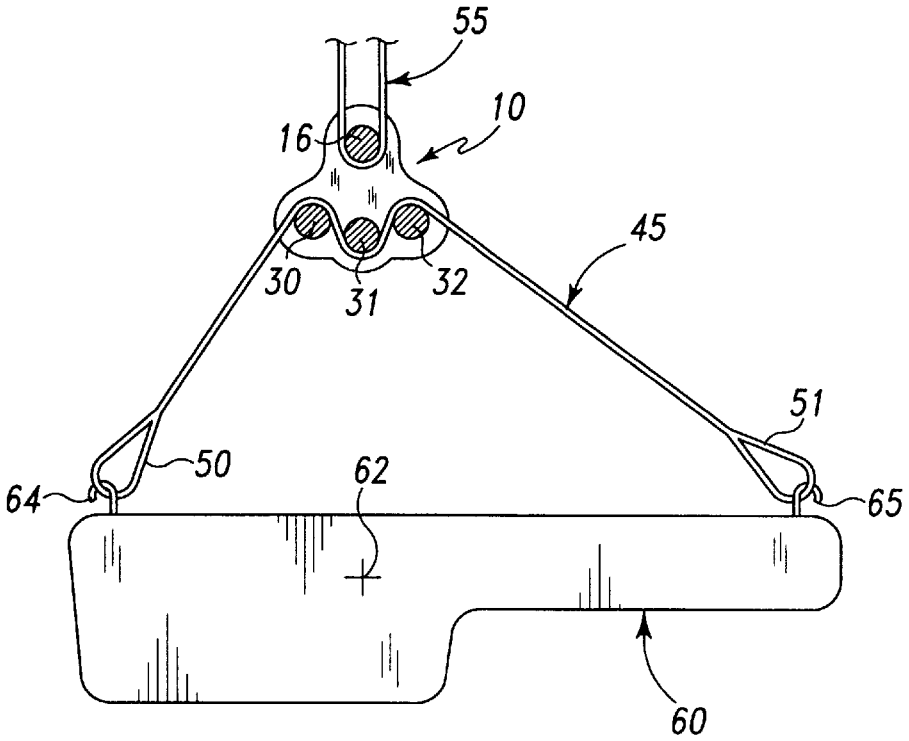
FIG. 5 is a diagrammatic, cross-sectional front view similar to the view of FIG. 4, wherein the sling rigging apparatus is being utilized to raise an eccentric load.

In FIGS. 3 and 4, there are shown a side view and a cross-sectional front view of sling rigging apparatus 10 in an operational arrangement and after being equipped with sling 45 and sling 55. In FIG. 5, apparatus 10 and slings 45 and 55 are further shown being used to raise an irregularly shaped load 60 with an offset center of gravity indicated at 62. Sling 45 is utilized to suspend load 60 from apparatus 10. Sling 55 is utilized to connect apparatus 10 to a lifting machine such as a crane hook.

As best shown in FIG. 3 by the segment of its length which is partially cut away, sling 45 is a round sling that has inner core 47 formed of multiple windings of a high strength fibrous strand, such as a strand of Kevlar®, encased within a fabric cover 49. Round slings of this general type are further disclosed in copending U.S. Pat. application Ser. No. 08/660,919, now U.S. Pat. No. 5,727,833, and U.S. Pat. No. 4,850,629, which are both incorporated herein by reference. As further abstractly illustrated in FIG. 5, round sling 45 is an eye-and-eye type sling, and an intermediate segment of its length weaves through the circuitous path defined by pins 30–32 as further described below. Differently shaped round slings, such as an endless sling, also may be employed as sling 45.

Sling 55 is also a round sling, and may be upwardly extended and attached to a not shown crane hook. If the round sling 55 employed is an eye-and-eye sling, the sling eyes are placed over the hook tip. If round sling 55 is an endless sling, a portion of the circumferential length of the sling may be draped over the hook. It will be appreciated that the crane hook may alternatively be attached directly to the shaft 16 in alternate rigging arrangements, or other rigging attachments such as shackles may be interposed between shaft 16 and the crane hook if desired for a particular application.

As best shown in FIG. 4, the spacing between pins 30, 31 and 32 forms a multi-curved or serpentine pathway which sling 45 assumes when weight is applied at the sling ends after sling extension through the pathway. The outer fabric cover 49 frictionally engages or rubs against the cylindrical periphery of different portions of pins 30–32. In the shown pin configuration, substantially all of the upward facing portions of the peripheries of pins 30 and 32 are in direct frictional engagement with sling 45, and substantially all of the downward facing portion of the periphery of pin 31 is covered by sling 45. As used in the specification and claims herein, multi-curved refers to the condition where centers of curvature of different parts of the sling pathway are positioned on different sides of that pathway. For example, with respect to the sling segments located in the pathway which press against pins 30 and 32, their centers of curvature correspond to the longitudinal axis of pin 30 and pin 32, respectively, which lie below sling 45. However, the center of curvature of the sling segment that presses against pin 31 is located at the longitudinal axis of pin 31 which lies above sling 45. When sufficient weight is suspended by sling 45 such as by lifting load 60, the frictional engagement of fabric cover 49 with the peripheries of steel pins 30–32 frustrates sliding movement of sling 45 along the pathway.

The structure of sling rigging apparatus 10 will be further understood with reference to its operation to lift load 60. To rig apparatus 10 to the crane hook, sling 55 is looped in an untwisted fashion under shaft 16. This rigging process is simplified by removing the locking clips and withdrawing all of pins 30–32 from their positions spanning front and rear plates 12 and 14, and then lowering apparatus 10 from above onto sling 55. Next, sling 45 is rigged to apparatus 10. A preferred manner of arranging sling 45 to be along the multi-curved sling pathway is to manipulate apparatus 10 such that pins 30 and 32 are installed as shown in FIG. 1, while pin 31 remains removed. After threading sling 45 between shaft 16 and the inserted pins 30 and 32 such that sling 45 drapes across the upper peripheries of pins 30 and 32, the sling portion spanning pins 30 and 32 may be pulled or looped down below apertures 21 and 25. While still holding the looped down sling portion, pin 31 may be slipped through apertures 21 and 25 to be inserted above sling 45 and locked in place with its locking clip. It will be recognized that when an endless sling is used as sling 45 and not doubled up or brought together to form a makeshift eye-and-eye sling, sling 45 will initially need to be inserted into apparatus 10 when all of pins 30–32 are removed. After the opposite eyes 50 and 51 of sling 45 are connected to abstractly shown fittings 64 and 65 connected to the ends of load 60, load 60 is ready to be lifted in the following fashion.

Initially, a user will place sling rigging apparatus 10 at a point along the length of sling 45 which would be the user's best estimate of the sling portion disposed above center of gravity 62 during level lifting of load 60. For example, as shown in FIG. 5, due to the irregularity of the shape of load 60, sling rigging apparatus 10 will be placed along the sling such that the segment or leg of sling 45 extending between sling rigging apparatus 10 and fitting 64 will be shorter than the sling leg extending between sling rigging apparatus 10 and fitting 65. When the crane hook positioned above apparatus 10 applies a lifting force on sling 55, sling rigging apparatus 10 is pulled upward. As the slack in sling 45 is lessened as apparatus 10 moves upward, apparatus 10 automatically tends to self-center or slide along the length of sling 45 toward the point above the actual center of gravity 62. When a machine, such as a fork-lift, is used instead of a crane and the lifting element of the machine is less readily movable side-to-side than a crane hook, the flexibility of sling 55 facilitates movement of apparatus 10 along sling 45.

Sling rigging apparatus 10 will continue to self-center until the frictional forces between the cover 49 of load suspending sling 45 and the cylindrical peripheries of pins 30–32 reach a level which prevents further sliding movement of sling 45. Continued raising of apparatus 10 will eventually cause load 60 to be lifted. Due to the self-centering tendency of apparatus 10, the attitude of load 60 may be sufficiently level. The engagement of sling 45 with the pin peripheries provides a frictional lock that prevents a level load from unbalancing or becoming uneven, and the load can be maneuvered to a desired location. If load 60 is not sufficiently level when finally lifted, which may have occurred because apparatus 10 was initially placed on sling 45 so far from the proper sling location that the self-centering tendencies of apparatus 10 did not completely correct the initial placement, load 60 is lowered to the ground such that a small amount of slack is provided in sling 45. Then, a single user may simply pull on the sling leg requiring lengthening to move sling 45 relative to apparatus 10 and thereby better even the load, and the load may be raised again with a more level attitude.

Sling rigging apparatus 10 finds beneficial employment with a variety of slings, such as synthetic slings, that may frictionally engage the pin peripheries. As used herein, synthetic slings broadly refers to non-metal slings and includes round slings, such as described above with reference to sling 45, and web slings, such as flat webs of material such as woven nylon or natural fibers that lack an internal core characteristic of round slings.

Figure 6:
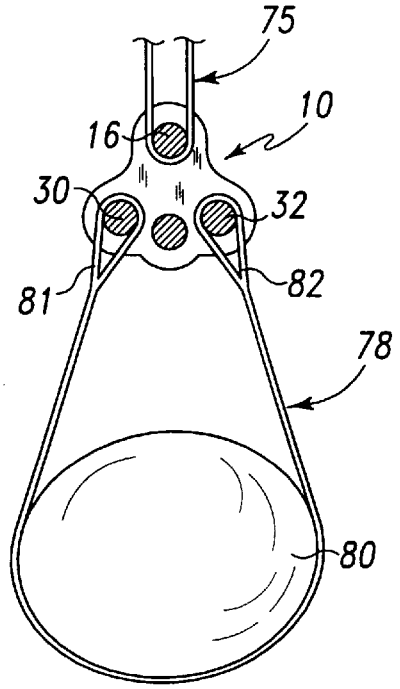
FIG. 6 is a diagrammatic, cross-sectional front view similar to the view of FIG. 4, wherein the sling rigging apparatus of FIG. 1 is being utilized with a sling arranged in a basket configuration.
Figure 7:
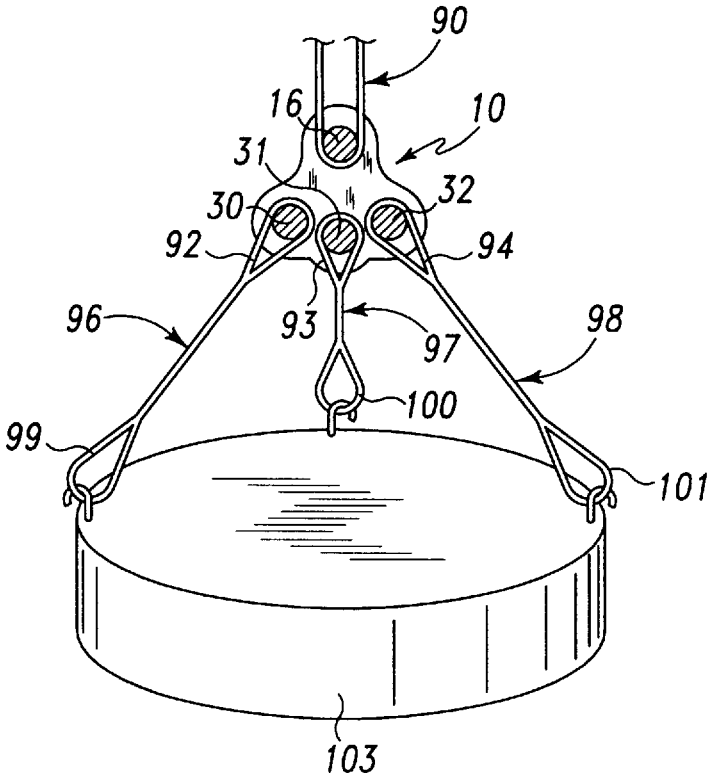
FIG. 7 is a diagrammatic, cross-sectional front view similar to the view of FIG. 4, wherein the sling rigging apparatus of FIG. 1 is being utilized with multiple eye-and-eye slings arranged to form a makeshift bridal.
Figure 8:
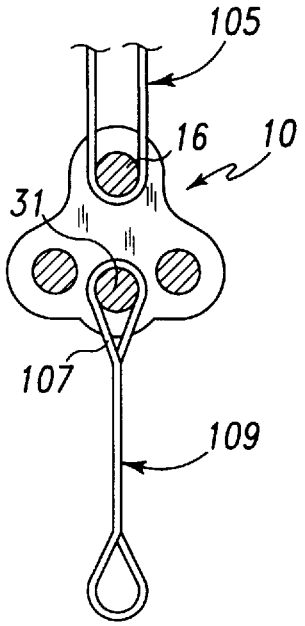
FIG. 8 is a diagrammatic, cross-sectional front view similar to the view of FIG. 4, wherein the sling rigging apparatus of FIG. 1 is being utilized as a connecting link.

In FIGS. 6–8, sling rigging apparatus 10 is shown being employed in other lifting configurations in which its design finds useful application. In FIG. 6, sling 75 extends between shaft 16 and a not shown crane hook. A single eye-and-eye sling 78 is arranged in a basket lift configuration lifting load 80. Sling 78 is rigged to apparatus 10 by removing pins 30 and 32 from the assembly shown in FIG. 1, and then positioning sling 78 such that pins 30 and 32 insert through sling eyes 81 and 82, respectively, when reassembled to apparatus 10. This basket configuration is highly suitable when the periphery of load 80 is abrasive or has sharp edges or holes which could harm a sling. The newer or expensive sling may be used as sling 75, and a less expensive sling, which a user is less concerned about replacing may be used around load 80.

In FIG. 7, sling rigging apparatus 10 is shown being used as part of a makeshift, three-legged bridal. Sling 90 is attached to shaft 16 and a not shown crane hook. Eyes 92, 93 and 94 of eye-and-eye slings 96, 97 and 98 are installed around pins 30–32. The opposite eyes 99, 100 and 101 are attached to fittings connected to various points of load 103 to be lifted. Rather than a three-legged bridal shown, apparatus 10 also may be used to form a two-legged bridal.

In FIG. 8, sling rigging apparatus 10 is shown being used as a connecting link between multiple slings. Sling 105 is attached to shaft 16 and a not shown crane hook, and an eye 107 of eye-and-eye sling 109 is installed around pin 31. In this configuration, apparatus 10 replaces multiple shackles which are less preferred as the rounded configuration of the shackles typically used may result in a bunching or bowing of the slings within the shackles which reduces the maximum loads that the slings are capable of carrying.

While this invention has been shown and described as having multiple designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A sling rigging apparatus comprising:

a first body member;

a second body member operatively connected with said first body member;

a suspension member on which an upward force may be applied to lift the first and second body members, said suspension member attached to at least one of said first and second body members; and a plurality of pins extending in a longitudinal direction to span a space between portions of said first and second body members, said plurality of pins comprising a first pin, a second pin, and a third pin, each of said plurality of pins including an exterior periphery, said pins being spaced from each other in a direction transverse to said longitudinal direction and arranged to define a multi-curved pathway along which a sling is positionable for frictional engagement with at least parts of the exterior peripheries of said plurality of pins, wherein said first pin and said third pin are disposed on opposite sides of said second pin, wherein said suspension member is disposed above said first and third pins, wherein said second pin is disposed below said first and third pins, and wherein each pin comprises a onepiece construction in the spanned space between portions of said first and second body members.

2. The sling rigging apparatus of claim 1 wherein said first pin and said third pin are disposed at least approximately at a first height on said first body member, and wherein said second pin is disposed at a second height on said first body member different from said first height.

3. The sling rigging apparatus of claim 1 wherein said suspension member comprises a spanning cylindrical shaft fixedly attached to upper portions of said first and second body members.

4. The sling rigging apparatus of claim 1 wherein said first body member comprises a first plurality of apertures, wherein said second body member comprises a second plurality of apertures in alignment with said first plurality of apertures, and wherein said plurality of pins are insertable through and withdrawable from said first and second plurality of apertures.

5. The sling rigging apparatus of claim 4 wherein each of said plurality of pins comprises a cylindrical shaft with first and second longitudinal ends, a head at said shaft first end sized larger than an aperture of said first plurality of apertures, and a cross bore proximate said shaft second end for accommodating insertion of a locking pin.

6. A sling rigging apparatus comprising:

a first body member comprising a first plurality of apertures;

a second body member operatively connected with said first body member, said second body member comprising a second plurality of apertures in alignment with said first plurality of apertures;

a suspension member on which an upward force may be applied to lift the first and second body members, said suspension member attached to at least one of said first and second body members;

a plurality of sling engageable pins, said plurality of pins comprising a first pin, a second pin and a third pin;

wherein each of said plurality of pins is movable in a longitudinal direction through aligned apertures of said first and second plurality of apertures to a first position spanning a space between portions of said first and second body members, whereby a sling portion may be engaged;

wherein each of said plurality of pins is movable through the aligned apertures of said first and second plurality of apertures to a second position not spanning said space between portions of said first and second body members, whereby the rigging of the sling portion is facilitated;

wherein said plurality of pins when arranged in said first position are substantially parallel and spaced from each other in a direction transverse to said longitudinal direction, said plurality of pins in said first positions being arranged to define a multi-curved pathway along which the sling portion is positionable for frictional engagement with at least parts of exterior peripheries of said plurality of pins: and said second pin being disposed at a horizontal location between said first and third pins and at a vertical location below said suspension member.

7. The sling rigging apparatus of claim 6 wherein said first and third pins are disposed at at least one vertical location between said second pin and said suspension member.

8. The sling rigging apparatus of claim 7 wherein said first and third pins are disposed at the same vertical location.

9. The sling rigging apparatus of claim 6 wherein said first body member comprises a first plate and said second body member comprise a second plate, and wherein said suspension member comprises a cylindrical shaft fixedly attached to upper portions of said first and second plates above said first and second plurality of apertures, wherein said cylindrical shaft and said plurality of pins bound an open space between said first and second plates, whereby an endless sling may be passed between said first and second plates and by each of said plurality of pins when disposed in said second position to enter said open space to be looped under and into direct engagement with said cylindrical shaft.

10. The sling rigging apparatus of claim 6 wherein each of said plurality of pins comprises a cylindrical shaft with first and second longitudinal ends, a head at said shaft first end sized larger than an aperture of said first plurality of apertures, and a cross bore proximate said shaft second end for accommodating insertion of a locking pin engageable with said second body member to prevent inadvertent moving of said pin from said first position to said second position.

11. A method of lifting a load with a lifting machine comprising the steps of:

providing a sling rigging apparatus comprising:

a body including a first body portion, a second body portion, and a third body portion; and a plurality of pins extending in a longitudinal direction to span a space between said first body portion and said second body portion, said pins being spaced from each other in a direction transverse to said longitudinal direction and arranged to define a multi-curved pathway;

positioning a first sling along said multi-curved pathway defined by said plurality of pins such that the first sling frictionally engages at least parts of exterior peripheries of said plurality of pins;

connecting the first sling to the load; and connecting the third body portion to the lifting machine to allow raising of the sling rigging apparatus, the sling and the load, wherein the step of connecting the third body portion to the lifting machine comprises looping a second sling under said third body portion after removing said plurality of pins from their positions spanning the space between said first and second body portions.

12. The method of claim 11 further comprising the step of selectively removing at least one of said plurality of pins from its position spanning the space between said first and second body portions to facilitate the step of positioning the first sling.

13. The method of claim 11 further comprising the step of selectively removing up to all of said plurality of pins from their positions spanning the space between said first and second body portions to facilitate the step of positioning the first sling.

14. The method of claim 11 wherein the first sling positioning step comprises providing a sling with a web shape.

15. The method of claim 11 wherein the first sling positioning step comprises providing a synthetic sling including a multi-winding, endless loop inner core and a fabric covering.

16. The method of claim 11 wherein said plurality of pins includes a first pin, a second pin, and a third pin, wherein the second pin is horizontally between and vertically below the first and third pins, and wherein the first sling positioning step comprises routing the first sling over the first pin, under the second pin, and over the third pin.

* * * * *